US006962239B2

(12) United States Patent
Shikai et al.

(10) Patent No.: US 6,962,239 B2
(45) Date of Patent: Nov. 8, 2005

(54) SLIDING DOOR SYSTEM WITH OPTICAL DETECTOR FOR SAFE DOOR OPENING AND CLOSING

(75) Inventors: Masahiro Shikai, Tokyo (JP); Toshiro Nakashima, Tokyo (JP); Kazuo Takashima, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 200 days.

(21) Appl. No.: 10/430,223

(22) Filed: May 7, 2003

(65) Prior Publication Data

US 2003/0209391 A1 Nov. 13, 2003

(30) Foreign Application Priority Data

May 8, 2002 (JP) ..... 2002-132333

(51) Int. Cl.[7] ..... B66B 13/14
(52) U.S. Cl. ..... 187/316; 49/28
(58) Field of Search ..... 187/316, 317, 187/391; 49/26–28, 118; 318/280–286, 466–470, 480

(56) References Cited

U.S. PATENT DOCUMENTS

| | | | | |
|---|---|---|---|---|
| 3,783,977 A | | 1/1974 | Voser | |
| 4,029,176 A | * | 6/1977 | Mills | 187/317 |
| 4,621,452 A | | 11/1986 | Deeg | |
| 4,847,485 A | * | 7/1989 | Koelsch | 250/221 |
| RE33,668 E | | 8/1991 | Gray | |
| 5,149,921 A | * | 9/1992 | Picado | 187/317 |
| 5,276,391 A | * | 1/1994 | Jonsson | 318/480 |
| 5,284,225 A | | 2/1994 | Platt | |
| 5,329,075 A | | 7/1994 | Hirabayashi et al. | |
| 5,420,430 A | | 5/1995 | Trett | |
| 5,569,888 A | * | 10/1996 | Kamani et al. | 187/317 |
| 5,581,944 A | * | 12/1996 | Kornbrekke et al. | 49/28 |
| 5,698,824 A | | 12/1997 | Platt | |
| 5,886,307 A | | 3/1999 | Full et al. | |
| 5,996,281 A | * | 12/1999 | Takano et al. | 49/26 |
| 6,304,178 B1 | * | 10/2001 | Hayashida | 340/545.1 |
| 6,631,788 B2 | * | 10/2003 | Shikai et al. | 187/316 |
| 6,782,660 B2 | * | 8/2004 | Takada et al. | 49/25 |
| 2002/0125077 A1 | | 9/2002 | Shikai et al. | |

FOREIGN PATENT DOCUMENTS

| | | |
|---|---|---|
| JP | 63-66084 | 3/1988 |
| JP | 11310375 | 11/1999 |

OTHER PUBLICATIONS

U.S. Appl. No. 10/031,063, filed Aug. 23, 2000, Masuda et al.

* cited by examiner

*Primary Examiner*—Jonathan Salata
(74) *Attorney, Agent, or Firm*—Leydig, Voit & Mayer, Ltd.

(57) ABSTRACT

A sliding door system has a pair of horizontally opposed vertical surfaces defining therebetween an opening, an upper horizontal surface connecting uppermost ends of the vertical surfaces, a lower horizontal surface connecting lowermost ends of the vertical surfaces, and a door moving horizontally to open and close the opening. The sliding door system also includes a first optical device having a light emitter for emitting light, a second optical device having a light detector for detecting the light, and a light reflector for reflecting the light emitted from the light emitter to the light receiver. The light reflector is positioned in at least one of the horizontally opposed vertical surfaces. The first and second optical devices are positioned in the upper horizontal surface.

17 Claims, 17 Drawing Sheets

SLIDING DOOR SYSTEM WITH OPTICAL DETECTOR FOR SAFE DOOR OPENING AND CLOSING

BACKGROUND OF THE INVENTION

1) Technical Field of the Invention

The present invention relates to a sliding door system, and in particular relates to the sliding door system used for any equipment and facility such as an elevator system and an automatic sliding door system in a building and automobile.

2) Description of Related Arts

There have been disclosed various elevator systems each equipped with a safety installation for preventing any members such as clothes from being drawn into a small gap defined between a slide door and a fixed wall adjacent to the door when the door opens a doorway into or out of an elevator cage. Among others, the Japanese Patent Publication No. 63-66084 (A) discloses such a safety system, in which a vertical recess is formed at a vertically extending corner edge between one vertical wall defining the doorway and the other vertical wall adjacent to the opening/closing door. A pair of a light emitter and receiver are provided at a top and bottom portions of the vertical recess in order to detect any members such as clothes positioned near the gap between the opening/closing door and the adjacent fixed wall and, if detected, to prohibit the opening operation of the door.

Also, the Japanese Patent Publication No. 11-310375 (A) discloses an another safety installation, which includes a pair of a light emitter and receiver positioned on a vertical line within a small gap or space defined between the opening/closing door and the adjacent fixed wall for the detection of any members which has been drawn into the space.

The safety installations, however, have respective drawbacks. For example, according to the former safety installation, dust or foreign matters are retained at the bottom of the vertical recess, which results in a false detection of the member. On the other hand, the latter safety installation is capable of detecting any members already existing in the gap, but it is incapable of preventing any members from being drawn into the gap.

Also, other safety installations of the elevator system are proposed in a commonly assigned and co-pending U.S. patent application Ser. No. 10/094,993 filed on Mar. 12, 2002, which is incorporated herein in its entirety by reference.

SUMMARY OF THE INVENTION

Accordingly, a sliding door system of the present invention has a pair of horizontally opposed vertical surfaces defining therebetween an opening, an upper horizontal surface connecting uppermost ends of the vertical surfaces, a lower horizontal surface connecting lowermost ends of the vertical surfaces, and a door moving horizontally to open and close the opening. The elevator system also includes a first optical device having a light emitter for emitting light, a second optical device having a light receiver for receiving the light, and a light reflector for reflecting the light emitted from the light emitter to the light receiver. The light reflector is positioned in at least one of the horizontally opposed vertical surfaces. The first and second optical devices are positioned in the upper horizontal surface. According to the elevator system of the present invention, any members or passenger's hands can be detected before being drawn into the recess between the vertical frame portion and the door or the gap between a pair of the opposing doors.

Further scope of applicability of the present invention will become apparent from the detailed description given hereinafter. However it should be understood that the detailed description and specific examples, while indicating preferred embodiments of the invention, are given by way of illustration only, since various changes and modifications within the sprit and scope of the invention will become apparent to those skilled in the art from this detailed description.

BRIEF DESCRIPTION OF THE DRAWINGS

The present invention more fully be understood from the detailed description given hereinafter and accompanying drawings which are given by way of illustration only, and thus are not limitative of the present invention and wherein.

DETAILED DESCRIPTION OF THE PREFERRED EMBODIMENTS

The present invention will be described herein with attached drawings, referring several embodiments of the sliding door system particular used for an elevator system. However, it should be noted that the present invention may suitably be adapted for any type of sliding door systems incorporated not only in the elevator system but also in any other facility and equipment such as a building and automobile.

Embodiment 1

Figure 1:
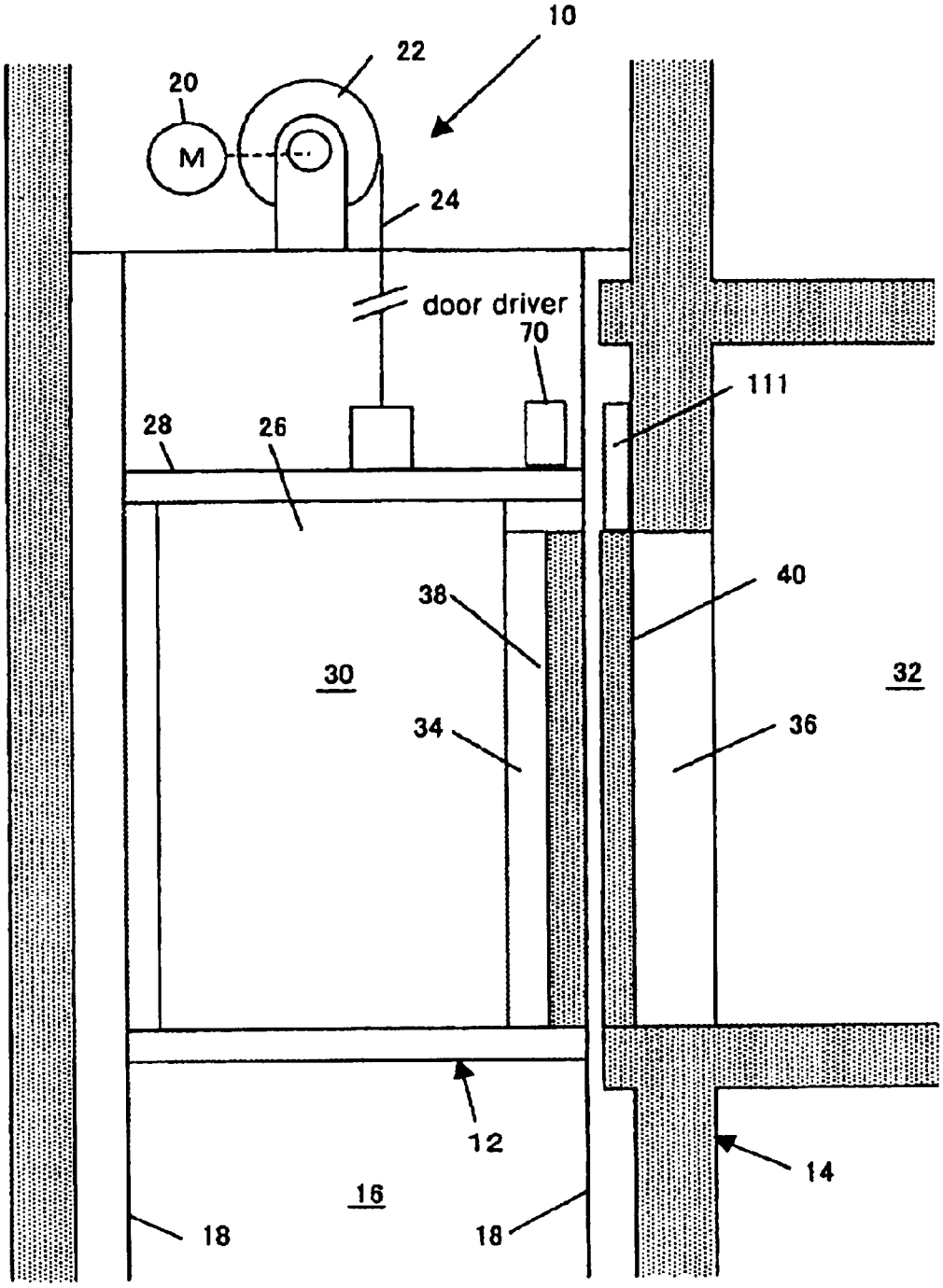
FIG. 1 is a schematic elevation view of an elevator system with a safety installation according to Embodiment 1 of the present invention.

Referring to FIG. 1, there is shown an elevator system generally indicated by reference numeral 10. The elevator system 10 includes an elevating member 12 elevating within a vertical shaft 16 constructed in a building 14 so that it is guided by a plurality of vertical guide rails 18 extending on opposite side walls defining in part the shaft 16. A wire-winding device 22 with a driving motor 20 is secured at the top of the shaft 16. A wire 24 is wound at its one end around a drum of the wire-winding device 22 and connected at its opposite end with the elevating member 12. This causes, by driving the motor 24 of the wire-winding device 22, the elevating member 12 to move up and down within the shaft 16.

The elevating member 12 has an elevator cage 26 defining therein a room for the transportation of the passengers and cargoes and a frame 28 provided around the cage 26 for the structural reinforcement of the cage. For the connection and disconnection between the room 30 defined within the cage 26 and each hall 32 of the building, a cage door system 38 is provided at a doorway (i.e., opening) of the cage 26 and a hall door system 40 is provided at each doorway (i.e., opening) of the hall 32.

Figure 2:
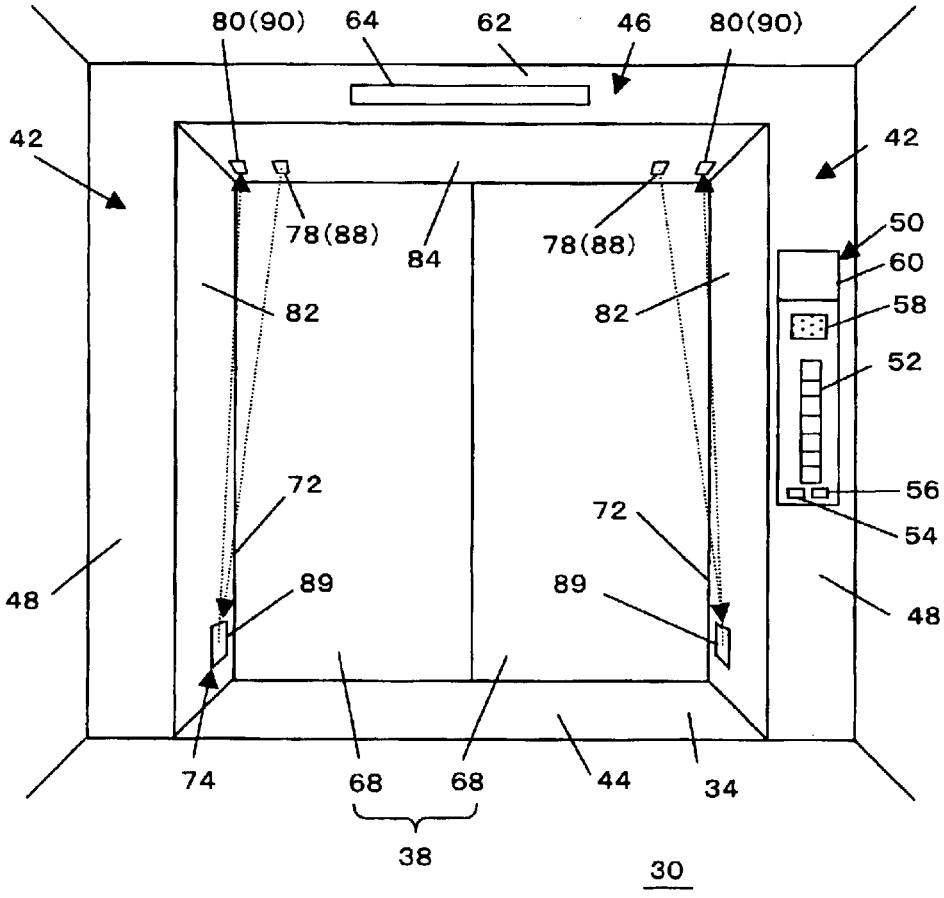
FIG. 2 is a side view of a cage entrance of the elevator system of Embodiment 1 when viewed from a cage.

As shown in FIG. 2, the doorway 34 of the cage 26 is defined within a rectangular frame. The frame includes a left and right vertical frame portions 42, a lower horizontal frame portion 44 connecting between the lowermost ends of the vertical frame portions 42, and an upper horizontal frame portion 46 connecting between the uppermost ends of the vertical frames 42. One of the vertical frame portions 42 has a front vertical wall 48 defining in part the room 30 and equipped with an operation panel 50. The operation panel 50 bears a plurality of hall designation buttons 52, an opening button 54, a closing button 56, a warning device 58 and a display device 60. The upper horizontal frame 46 supports, in its front wall, indication lamps 64 for the indication of the position of the cage 26 within the shaft 16.

Figure 4:
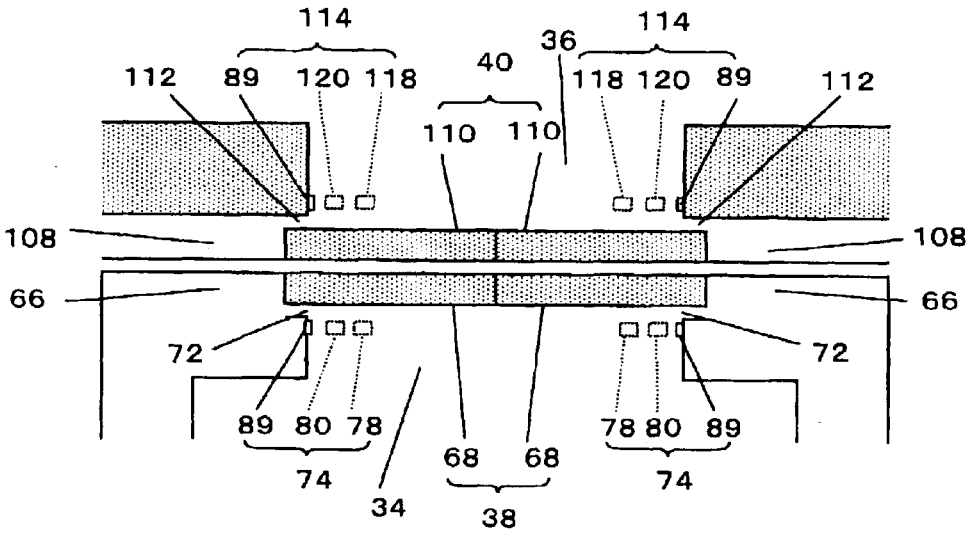
FIG. 4 is a schematic horizontal cross sectional view of the cage and hall entrances of the elevator system, in which the doors are closed.
Figure 5:
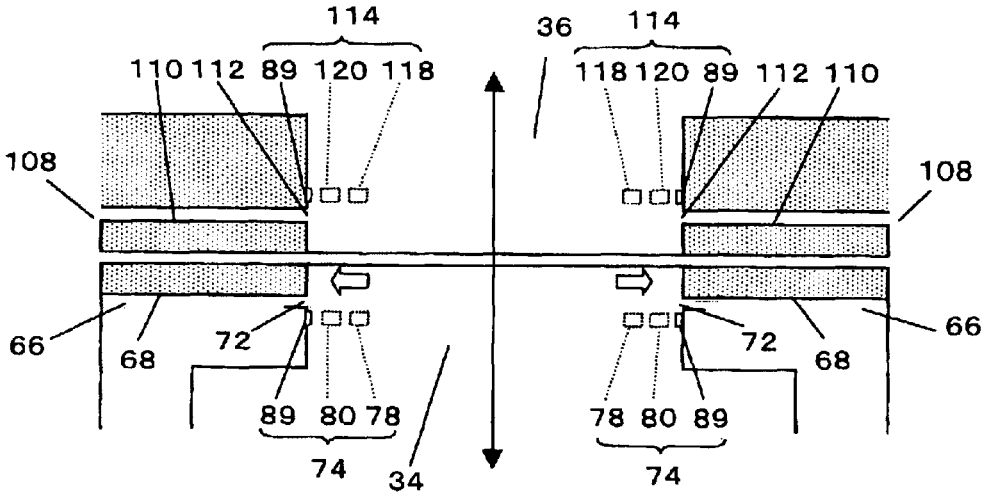
FIG. 5 is a schematic horizontal cross sectional view of the cage and hall entrances of the elevator system, in which-the doors are opened.

The door system 38 is a double-leaf door with two door portions or leaves, each extracting from leaf chambers 66 defined behind the left and right vertical frames 42 into the doorway 34 (see FIGS. 4 and 5). Each door leaf 68 is drivingly connected with a drive mechanism (door driver) 70 (see FIG. 1) provided at a certain position of the cage 26 so that it moves between a closing position (extracted position) and an opening position (retracted position). In the closing position, a leading vertical end surface of one door leaf contacts with the opposing leading vertical end surface of the other door leaf to close the doorway 34. In the opening position, on the other hand, each of the door leaves 68 is fully received within the associated leaf chamber 66.

Preferably used for the drive mechanism 70 is one disclosed in the U.S. Pat. No. 3,783,977, which is equipped with an electric motor and a mechanism for changing a rotation generated by the motor into a translation of the door leaves, and incorporated herein in its entirety by reference.

Referring back to FIG. 2, the elevator cage 26 is provided with a safety installation 74 in order to prevent any members such as passenger's clothes and hands from being drawn into the gap 72 defined between the vertical frame 42 and the opening door leaf 38. For this purpose, the safety installation 74 has a first and second optical devices 78, 80 and a light reflector 89. The first and second optical devices 78, 80 are mounted in and flush with the-upper horizontal surface 84 of the frame defining the upper end of the doorway 34. Also, the light reflector 89 is mounted in and flush with the opposing vertical surfaces 82 of the frame defining the left and right ends of the doorway 34. In this embodiment, a light emitter 88 is used for the first optical device 78 and a light receiver 90 is used for the second optical device 80 so that the light emitted from the light emitter 88 is reflected off at the light reflector 89 and received by the light receiver 90.

In order to detect any members such as the passenger's hands which may exist near the gap 72, the light reflector 89 is provided adjacent to the lowermost end of the vertical surface 82 of the frame, preferably about 10–30 cm away from the lowermost end of the vertical surface 82. The second optical device 80 is provided adjacent to the left/light ends of the upper horizontal surface 84 of the frame, preferably about 5–25 cm away from the uppermost end of the vertical surface 82. The first optical device 78 is provided further away from the vertical surface 82 than the second optical device 80. Also preferably, the first and second optical devices 78, 80 and the light reflector 89 are mounted as close to the gap 72 as possible so as to detect any members adjacent to the gap 72.

The most significant feature of the safety installation 74 of the present invention is that a surface of the light reflector 89 facing to the doorway 34 is substantially flush with the vertical surface 82 of the frame. Also, surfaces of the light emitter 88 and light receiver 90 are substantially flush with the upper horizontal surface 84 of the frame. This prevents the light emitter 88, the light receiver 90 and the light reflector 89 from being damaged by the contacts with cargoes moving past the doorway 34. Also, both surfaces of the light emitter 88 and the light receiver 90 through which light is emitted and received, respectively, are faced downward so that substantially no dust would adhere thereto. Further, a surface of the light reflector 89 at which light is reflected is oriented vertically so that substantially no dust would adhere thereto.

Figure 3:
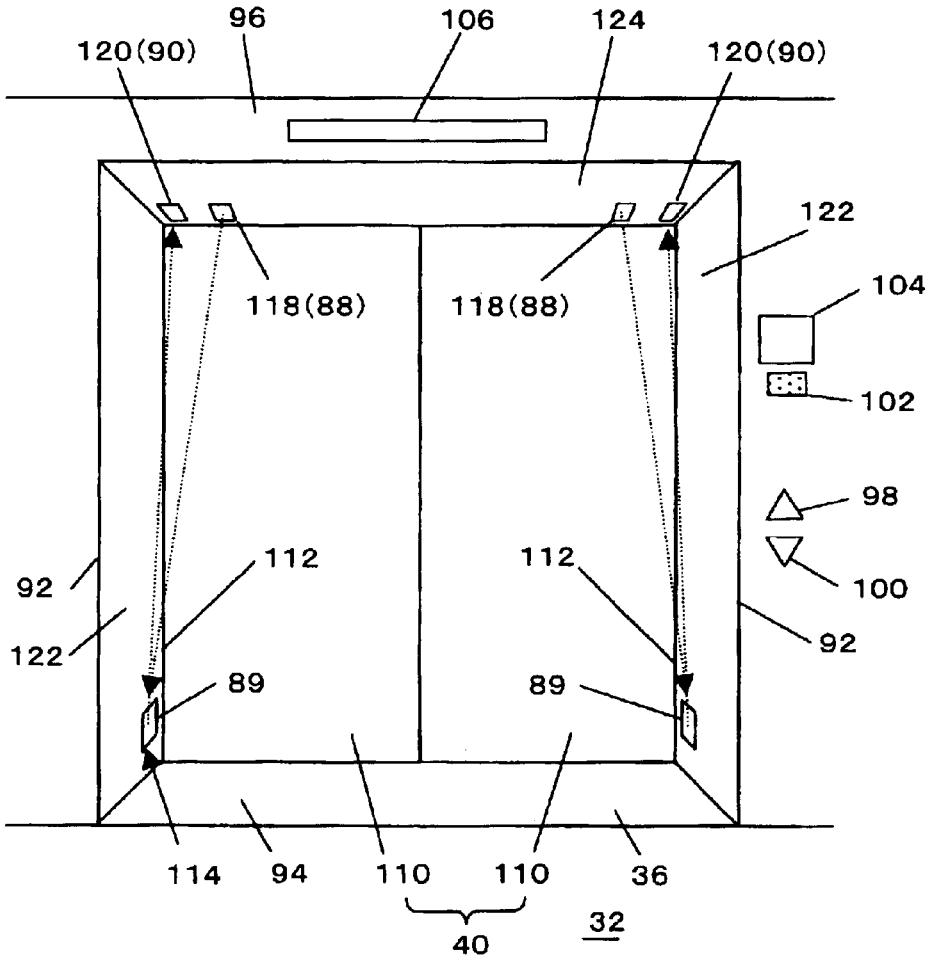
FIG. 3 is a side view of a hall entrance of the elevator system of Embodiment 1 when viewed from a hall.

Referring next to FIG. 3, an another doorway or opening 36 of each hall of the building is defined within a rectangular frame. The frame includes left and right vertical frame portions (vertical walls) 92, lower horizontal frame portion (floor wall) 94 connecting between the lowermost ends of the vertical frame portions 92, and upper horizontal frame portion 96 connecting between the uppermost ends of the vertical frames 92. In addition, the left and/or right vertical wall portions of the doorway 36 support an upward hall button 98, a downward hall button 100, a warning device 102 and a display device 104. Also, the upper horizontal frame 96 supports an indicator or lamp 106 indicating the position of the cage 26 within the shaft 16.

The hall door system 40 is also a double-leaf door with two door portions or leaves 110 each extracting from leaf chambers 108 defined behind the left and right vertical frames 92 into the doorway 36 (see FIGS. 4 and 5). The left and right door leaves 110 are mechanically connected-with a drive mechanism (door driver) 111 (see FIG. 1) for opening/closing the hall door leaves. The drive mechanism 111 is designed so that, when the cage 26 arrives at the hall 32, it engages with the associated drive mechanism 70 mounted on the cage 26. This causes the hall door 40 to operate between the closed position shown in FIG. 4 and the opened position shown in FIG. 5, in synchronism with the opening and closing operation of the cage door 38.

Similar to those for the cage 26, the hall 32 also has two sets of safety installations 114 provided on opposite sides of the doorway 36 to prevent any members such as passenger's clothes and hands from being drawn into a gap 112 between the vertical frame 92 and the adjacent opening door leaf 110. The safety installation 114 includes a first and second optical devices 118, 120 and a light reflector 89. The first and second optical devices 118, 120 are mounted in the upper horizontal surface 124 of the frame defining the upper end of the entrance 36. Also, the light reflector 89 is mounted in the vertical surfaces 122 of the frame defining the left and right ends of the doorway 36. In this embodiment, the first and second optical devices 118 and 120 have a light emitter 88 and a light receiver 90, respectively, so that light from the emitter 88 is reflected off at the light reflector 89 and received by the receiver 90.

In order to detect any members such as passenger's clothes and hands adjacent to the gap 112, the light reflector 89 is provided adjacent to the lowermost end of the vertical surface 122, preferably about 10–30 cm away from the lowermost end of the vertical surface 122. The second optical device 120 is provided adjacent to the left/light ends of the upper horizontal surface 124, preferably about 5–25 cm away from the uppermost end of the vertical surface 122. Also, the first optical device 118 is provided further away from the vertical surface 122 than the second optical device 120. Also preferably, the first and second optical devices 118 and 120 are mounted as close to the gap 112 as possible, i.e., adjacent to the elevator shaft.

Also in the safety installation 114 of the hall 32, the light reflecting surface of the light reflector 89 facing to the doorway 36 is substantially flush with the vertical surface 122. Thus, the light reflector 89 does not protrude nor retracted from the vertical surface 122. Also, the light emitting and receiving surfaces of the light emitter 88 and the light receiver 90 are substantially flush with the horizontal surface 124. This prevents the light emitters 88, the light receivers 90, and the light reflector 89 from being damaged by the possible contacts with cargoes, also prevents the surfaces of the light emitters and receivers from being covered with dust. In addition, the light reflecting surface of the light reflector 89 is vertically provided so that no dust is covered thereon.

Figure 6:
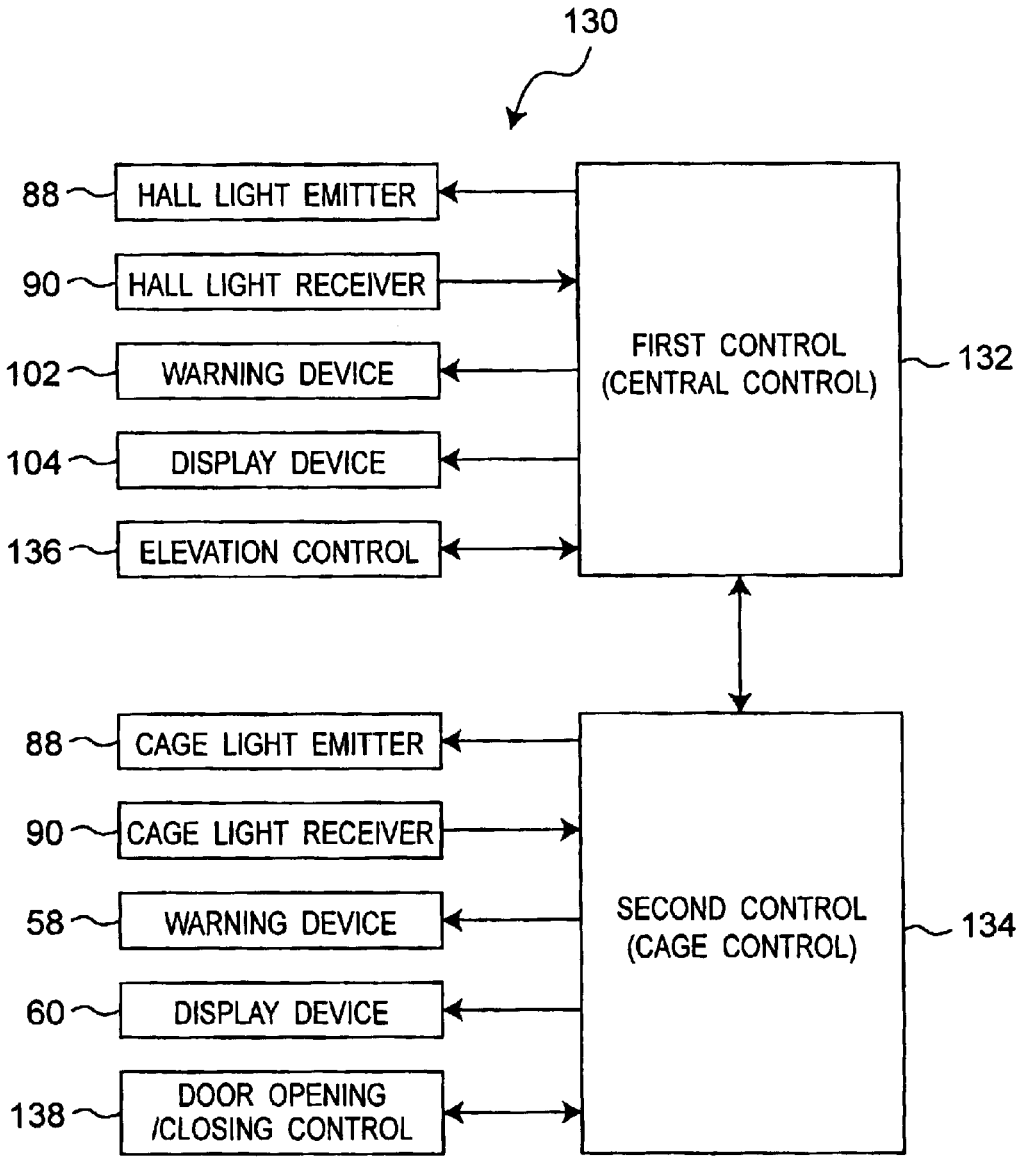
FIG. 6 is a block diagram of a control circuit of the safety installation of the elevator system.

FIG. 6 shows a control circuit 130 for the safety installations 74, 114. In general, the control circuit 130 includes a first control (a central control) 132 for controlling various parts or devices mounted, in particular, in the building and a second control (a cage control) 134 for controlling various parts and devices mounted on the cages 26. The first and second controls 132, 134 are electrically communicated with each other. The first control 132 is connected with the light emitter 88, the light receiver 90, the warning device 102 and the display device 104 provided for each hall 32 and an elevation control 136 for controlling the motor 20. The second control 134 is connected with the light emitter 88, the light receiver 90, the warning device 58 and the display device 60 provided for the cage 26 and a door opening/closing control 138 for controlling the drive mechanism 70.

Figure 7:
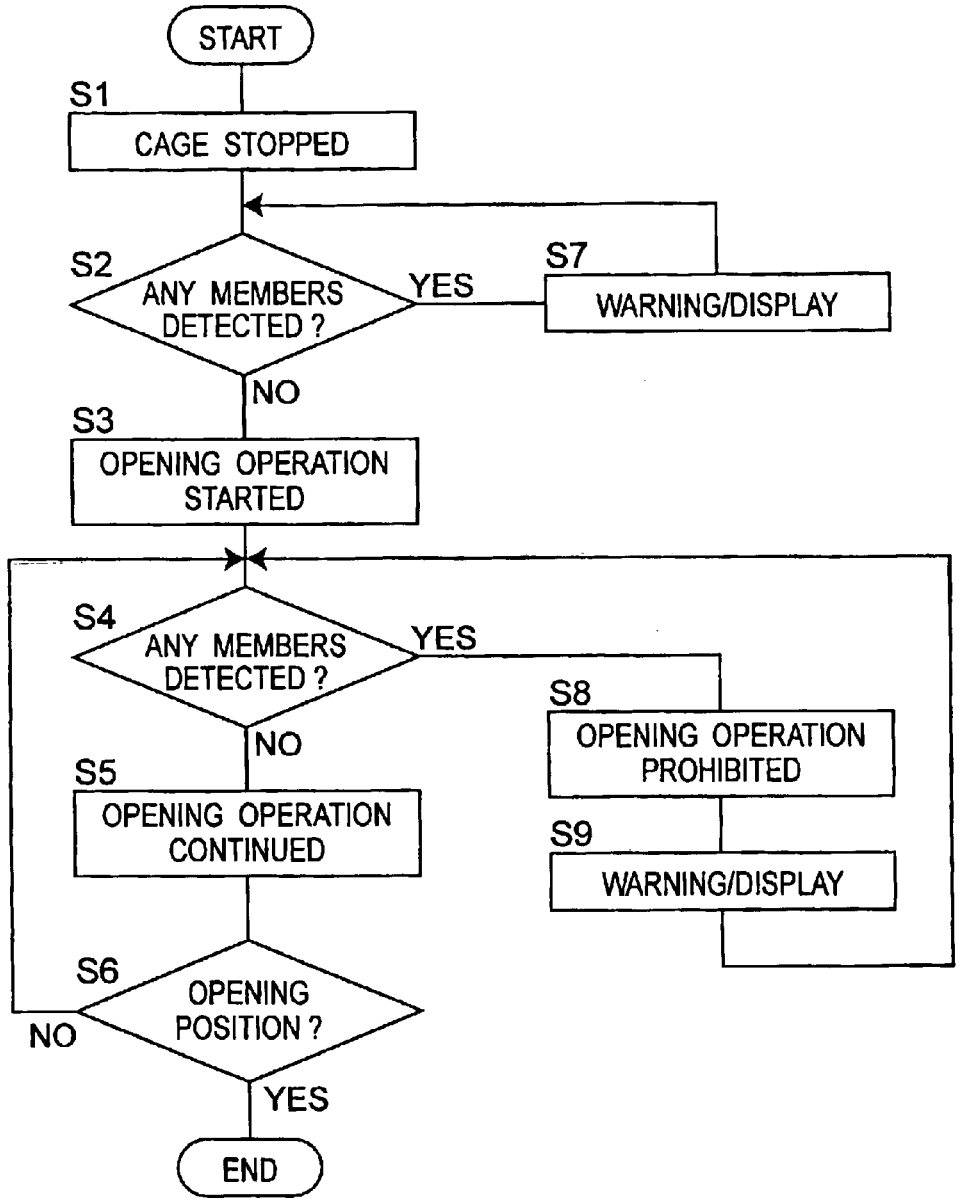
FIG. 7 is a flowchart showing a door opening operation of the safety installation.

FIG. 7 shows a flowchart showing the control operation of the control circuit 130 for the cage and hall safety installations 74, 114. According to this operation, at Step S1, the cage 26 stops in the shaft at a certain floor. At Step S2, the first and second controls 132, 134 determine whether an amount of the light emitted from the light emitter 88 and received by the light receiver 90 is less than a predetermined value. If the amount of the light is less than it, then the controls 132, 134 determine that there are any members or passenger's hands adjacent to the gaps 72, 112 cutting the light between the light emitter 88 and light reflector 89 and/or between the light reflector and the light receiver 90. Also, if the amount of light is over than the predetermined value, the controls 132, 134 determine that there is no problem. At Step S7, in case where there is a problem, the controls 132, 134 energize the associated warning device 58 or 102 to provide a warning necessary for the passengers in the cage 26 or hall 32. The warning may be a buzzer, message (e.g., "Please step away from door."), or combination thereof. In addition to such acoustic warnings, any visual warning messages may be displayed simultaneously on the display devices 60, 104. After Step S7, Step S2 is again followed by Step S7.

If it is determined that at Step S2 that there exists no member adjacent to the gap, the opening operation of the opposing door leaves 38 and 40 is processed at Step S3. Also, in the opening operation, it is determined whether any members exist adjacent to the gap at Step S4 as well as Step S2. If there exists no member adjacent to the gap, then the opening operation is continued at Step S5 until it is determined that the opening operation of the opposing door leaves 38 and 40 are completed at Step S6. Before the completion of the opening operation, the operation is returned to Step S4. Contrary, at Step S4, it is determined that something is close to the gap and might be drawn therein, the opening operation is prohibited at Step S8, and also the controls 132, 134 energize the associated warning device 58 or 102 to provide a warning necessary for the passengers in the cage 26 or the hall 32 at Step S9, before returning to Step S4.

As described above, according to the safety installations 74, 114, if any members existing adjacent to the gaps 72, 112 between the door leaf 38, 40 and the neighboring frame defining the door chamber 66, 108, respectively, are detected, the opening operation of the door leaf 38, 40 are prohibited so as to prevent any members from being drawn into the gap 72, 112. Although the descriptions have been made to the double-leaf door, the present invention may equally be applied to the single-leaf door.

Figure 8:
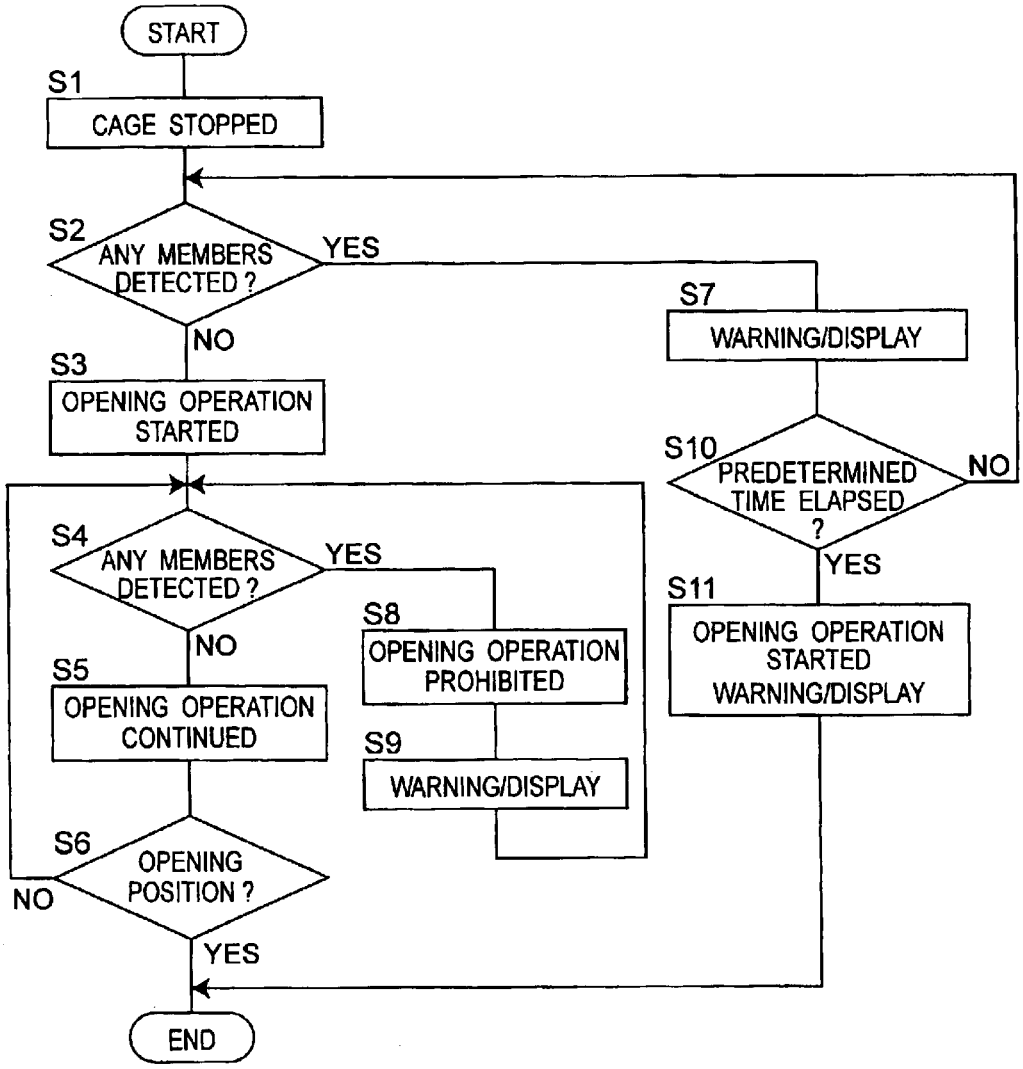
FIG. 8 is a flowchart showing another door opening operation of the safety installation.

In the operation of the flowchart shown in FIG. 7, Step S2 is followed by Step S7 automatically and without any conditions. Meanwhile, in the operation shown in the flowchart of FIG. 8, it is determined whether a certain time period elapses at Step S10, and if it does not, Step S2 is repeated, but it does, the door leaves 38, 40 are opened, preferably at an another opening speed lower than the usual one. Simultaneously, the warning device 58 or 102 may be energized to provide a necessary warning to the passengers at Step S11. According to the operation, after the cage is stopped at the hall, the opening operation can be conducted while securing the safety for a predetermined time. In other words, according to the operation, the undesired time where the door leaves are prohibited to open is eliminated so that passengers do not have to await the redundant time. This achieves the elevator system that can be operated in an efficient manner.

Figure 9:
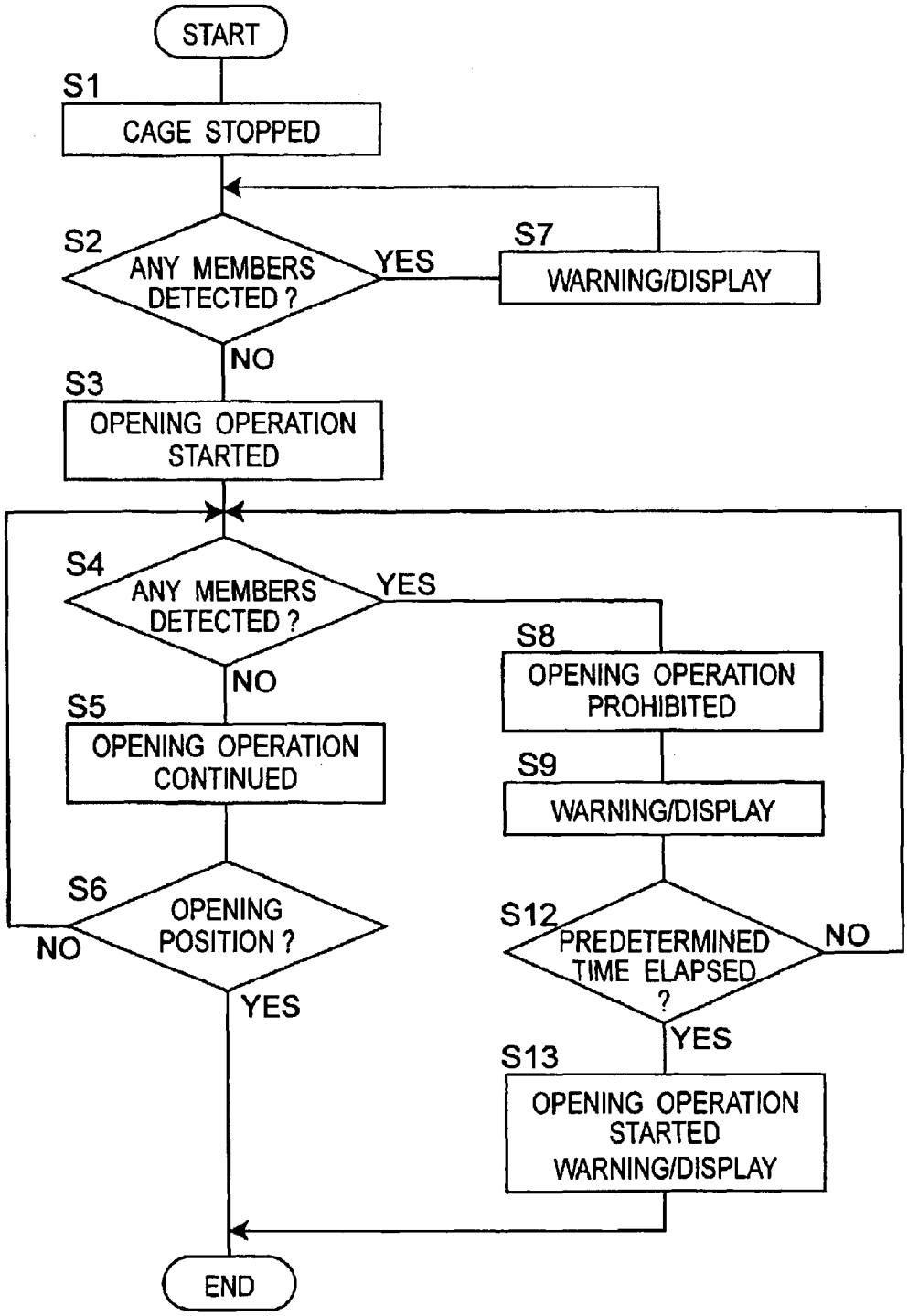
FIG. 9 is a flowchart showing another door opening operation of the safety installation.

Also, in the operation of the flowchart shown in FIG. 7, Step S4 is followed by Step S9 automatically and without any conditions, meanwhile, in the operation of the flowchart shown in FIG. 9, it is determined whether a certain time period elapses at Step S12, and if it does not, Step S4 is repeated, but it does, the door leaves 38 and 40 are opened, preferably at an another opening speed lower than the usual one. Simultaneously, the warning device 58 or 102 may be energized to provide a necessary warning to the passengers at Step S13. According to the operation, even after the door is driven to open while securing the safety for a predetermined time, the opening operation can be conducted. In other words, according to the operation, the undesired time where the opening operation is prohibited is eliminated so that passengers do not have to await the redundant time, thereby achieving the elevator system that can be operated in an efficient manner.

Figure 10:
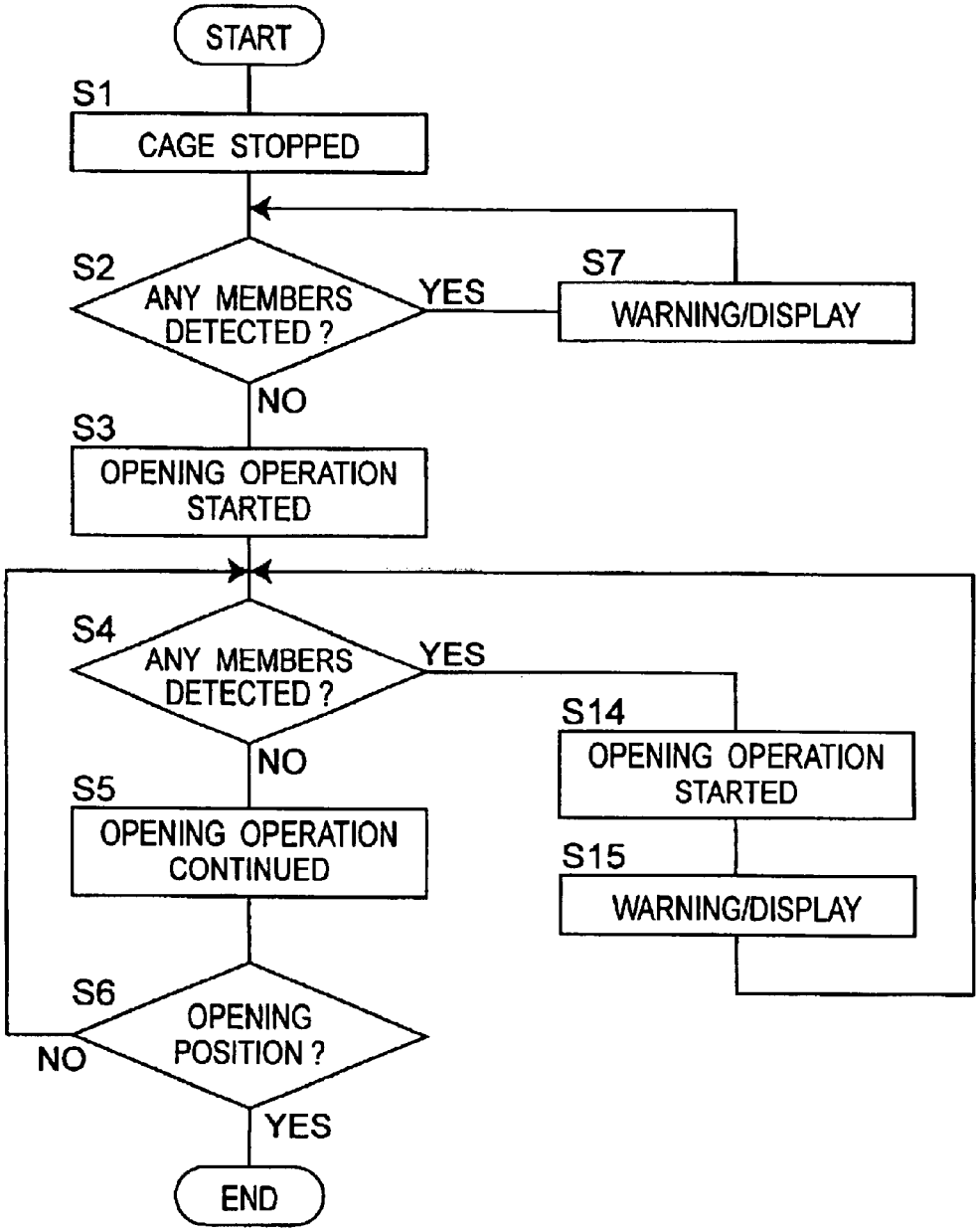
FIG. 10 is a flowchart showing another door opening operation of the safety installation.

In the operation of FIG. 7, the opening operation is prohibited if any members existing adjacent to the gaps 72, 112 are detected at Step S4. Also, as shown in the flowchart of FIG. 10, if any members are detected, the doors can be driven to halt (prohibit) and close at Step S14. Then the warning device 58, 102 may be energized to provide a necessary warning to the passengers at Step S15 to achieve the advantages similar to those of the other embodiments.

In the aforementioned embodiments, if an amount of the light emitted from the light emitter 88 and received by the light receiver 90 is less than a predetermined value, then it is determined that there are any members or passenger's hands adjacent to the gaps. Also, it can be determined that any members exit if the amount of light received by the light receiver 90 is beyond a predetermined range, i.e., more and less than a predetermined upper and lower values, respectively. In case that the amount of light received by the light receiver 90 is more than the upper value, it is reflected off at any members to the light receiver 90 through a shorter optical path. Also, in case that the amount of light received by the light receiver 90 is less than the lower value, it is reflected off at any members and not received by the light receiver 90. In the present embodiment, the light receiver 90 and the light emitter 88 may be arranged adjacent to each other.

Embodiment 2

Figure 11:
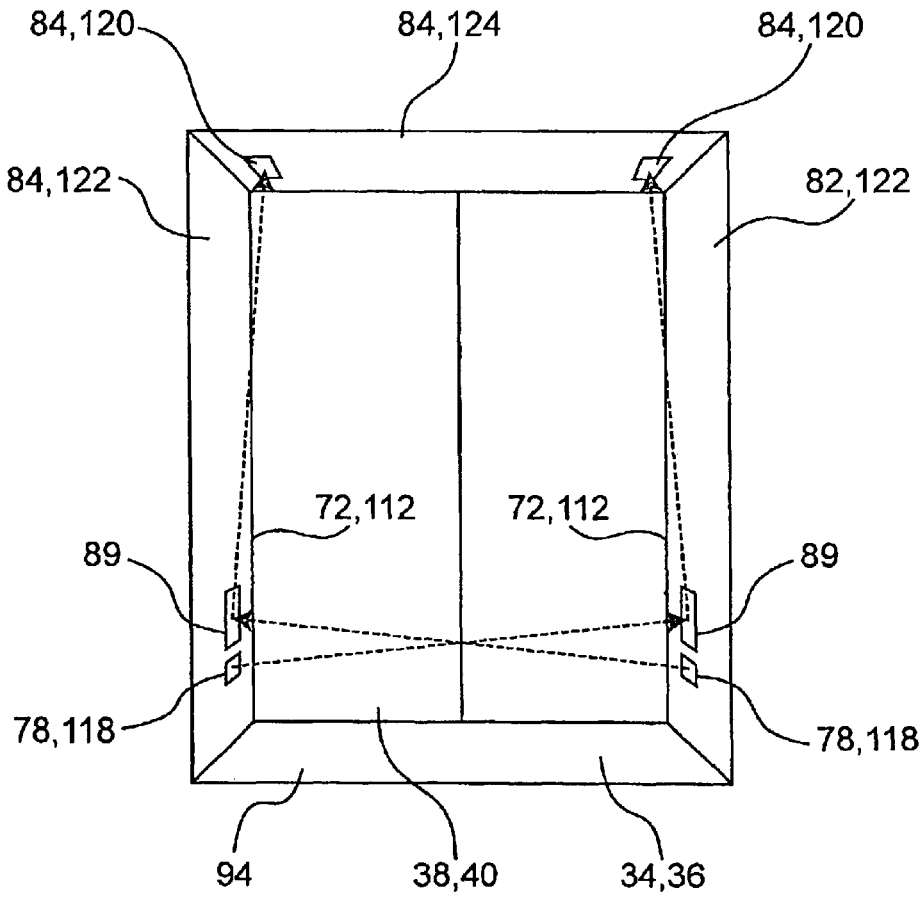
FIG. 11 is a side view of the cage/hall entrance of the elevator system of Embodiments 2 and 3.
Figure 12:
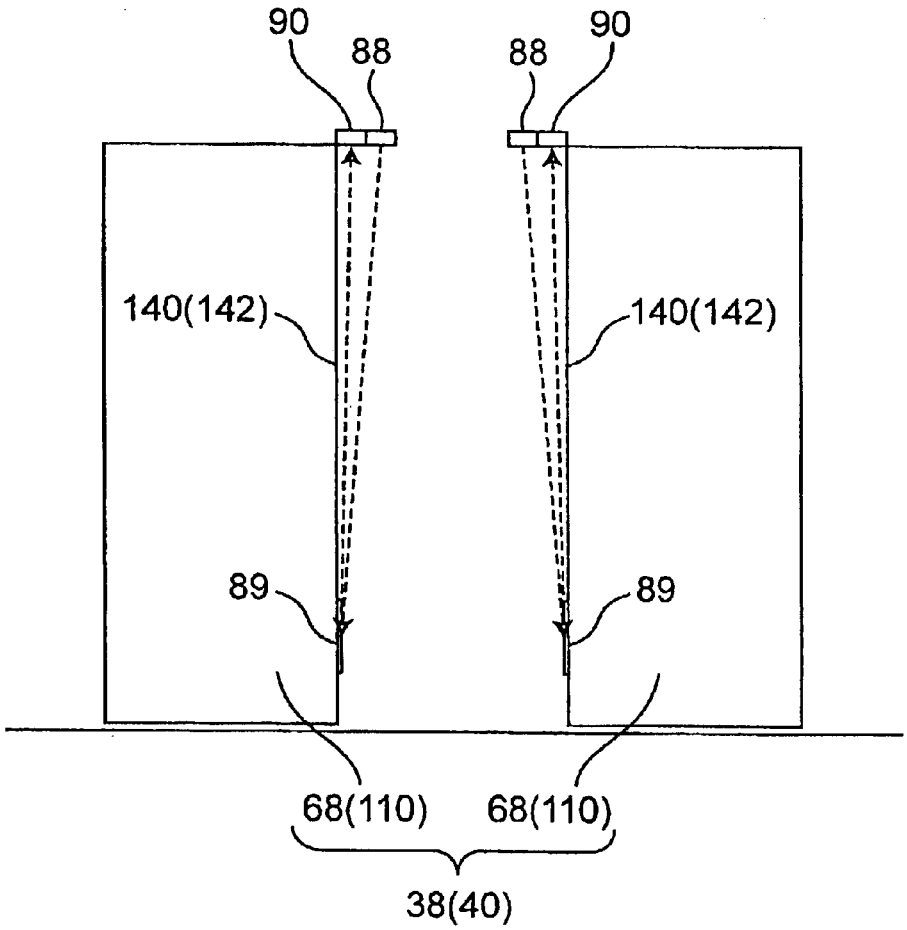
FIG. 12 is a side view of the cage/hall entrance of the elevator system of Embodiment 4.

In the safety installations shown in FIGS. 2 and 3, the first optical devices 78, 118 are mounted in and flush with the upper horizontal surface 84, 124 of the frame defining the upper end of the doorway 34, 36. As illustrated in FIG. 11, they may also be mounted in the vertical surface 82, 112 opposing to the light reflectors 89. The surfaces of the first optical devices 78, 118 facing to the doorway 34, 36 is arranged substantially flush with the vertical surface 82, 112.

Embodiment 3

Although the light emitter 88 and the light receiver 90 are used as the first optical devices 78, 118 and the second optical devices 80, 120, respectively, in the above-mentioned embodiments, the light receiver 90 and the light emitter 88 may be used as the first optical devices 78, 118 and the second optical devices 80, 120, respectively.

Embodiment 4

In the aforementioned embodiments, the optical devices such as the light emitter, the light receiver, and the light reflector are positioned in and flash with the fixed upper horizontal and vertical frames defining the doorway, meanwhile, those optical devices may be provided in the opening/closing doors. In particular, as illustrated in FIGS. 11 to 16, each door of the double-leaf doors has a leading vertical end surface 140, 142 opposing to the another door on which the light reflector 89 is provided. Each of the light reflectors 89 is arranged in and substantially flush with the leading vertical end surface of the door so that it does not protrude nor retract from the leading vertical end surface. On the other hand, the light emitter 88 and the light receiver 90 provided with one door are fixed protruding from the leading vertical end surfaces 140, 142 towards the another door. According to the embodiment of the safety installation illustrated in FIG. 12, the light emitted by the light emitter 88 is reflected off at the light reflector 89 fixed in the leading vertical end surface to the light receiver 90, each fixed on the same door leaf.

Figure 13:
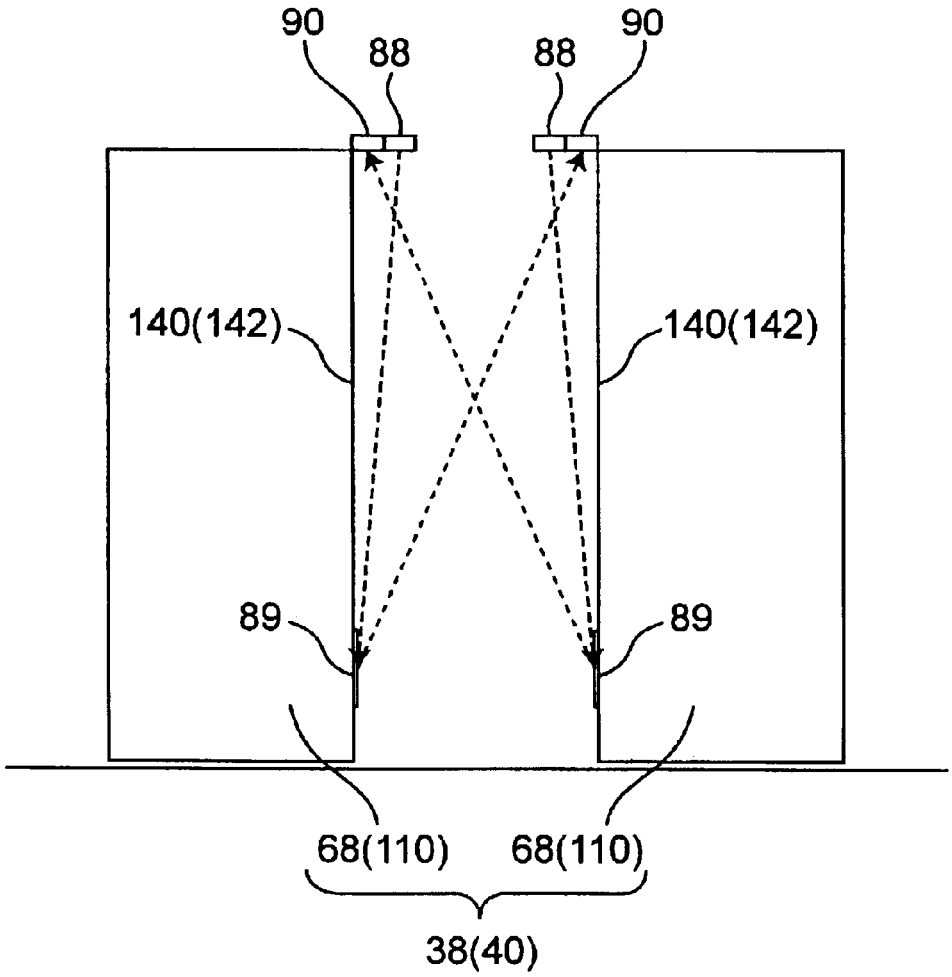
FIG. 13 is a side view of the cage/hall entrance of the elevator system of Embodiment 4, illustrating another arrangement of the safety installation.

According to another embodiment of the safety installation illustrated in FIG. 13, the light emitted by the light emitter 88 fixed on one door leaf is reflected off at the light reflector 89 fixed in the leading vertical end surface of the same door leaf to the light receiver 90 fixed on the other door leaf.

Figure 14:
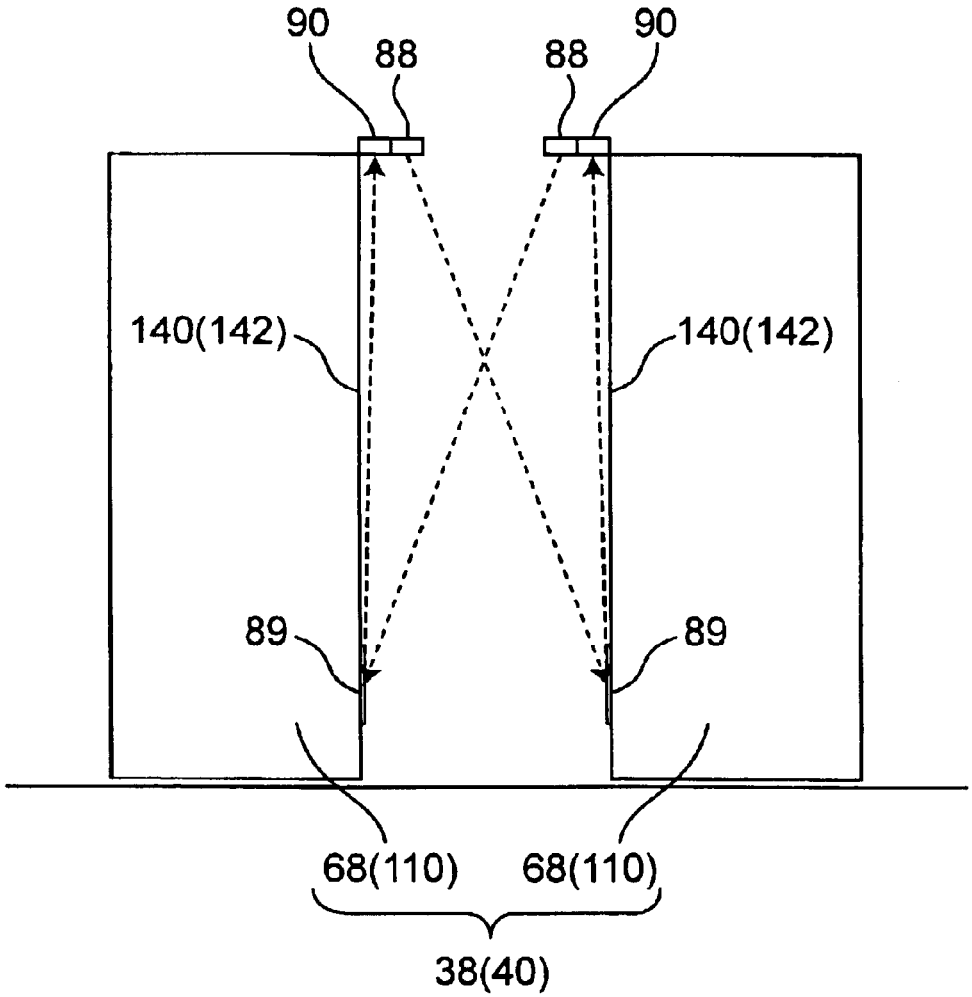
FIG. 14 is a side view of the cage/hall entrance of the elevator system of Embodiment 4, illustrating another arrangement of the safety installation.

According to further another embodiment of the safety installation illustrated in FIG. 14, the light emitted by the light emitter 88 fixed on one door leaf is reflected off at the light reflector 89 fixed in the leading vertical end surface of the other door leaf to the light receiver 90 fixed on the other door leaf. If there exist any members or passenger's hands between the door leaves 68 or 110, interfering the light so that the amount of light received by the light receiver 90 is reduced, then the existence of any members or passenger's hands can be detected. Thus, any members or passenger's hands are prevented from being drawn in the gap between the vertical frame and the door and between the opposing doors, which improves the safety of the elevator system. Also, since each of the light emitter 88, the light receiver 90, and the light reflector 89 is provided in and flush with the associate surface, they can be prevented from being damaged by any contacts of the cargoes or the hand trucks moving past the doorway. In addition, since the light emitting and receiving surfaces of the light emitter 88 and the light receiver 90 face downwardly so that no dust is retained on the light emitting and receiving surfaces. Also, since the reflecting surface of the light reflector 89 is arranged in the leading vertical end surfaces 140, 142, no dust is retained on the reflecting surface. No dust on the surfaces eliminates any adverse affect on the original optical feature of the safety installation.

Figure 15:
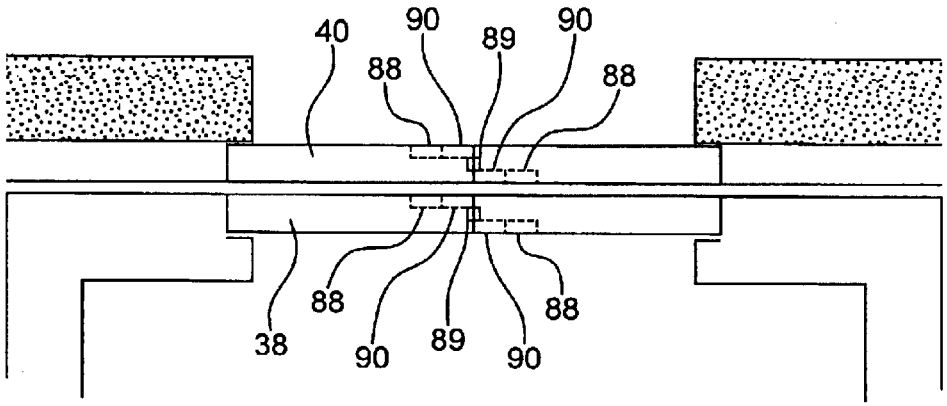
FIG. 15 is a schematic horizontal cross sectional view of the cage and hall entrances of the elevator system of Embodiment 4, in which the doors are closed.
Figure 16:
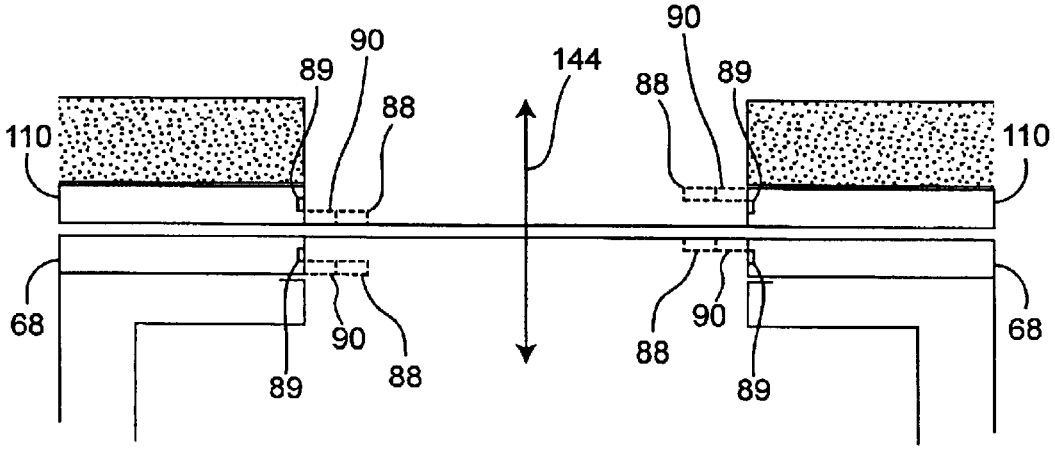
FIG. 16 is a schematic horizontal cross sectional view of the cage and hall entrances of the elevator system of Embodiment 4, in which the doors are opened.

It should be noted that the light emitter 88 and the light receiver 90 have to be positioned on the top portions of the door leaves 68, 110 in an offset manner along the crossing direction of the doorway (along the direction indicated by an arrow 144) as shown in FIGS. 15 and 16 so that no optical interference is occurred between the lights received by the light receivers. Although the light receiver 90 is illustrated closer to the leading vertical end surface of the door leaf than the light emitter 88 the above-mentioned embodiment, the light emitter 88 may be closer to the leading vertical end surface of the door leaf than the light receiver 90.

Embodiment 5.

Figure 17:
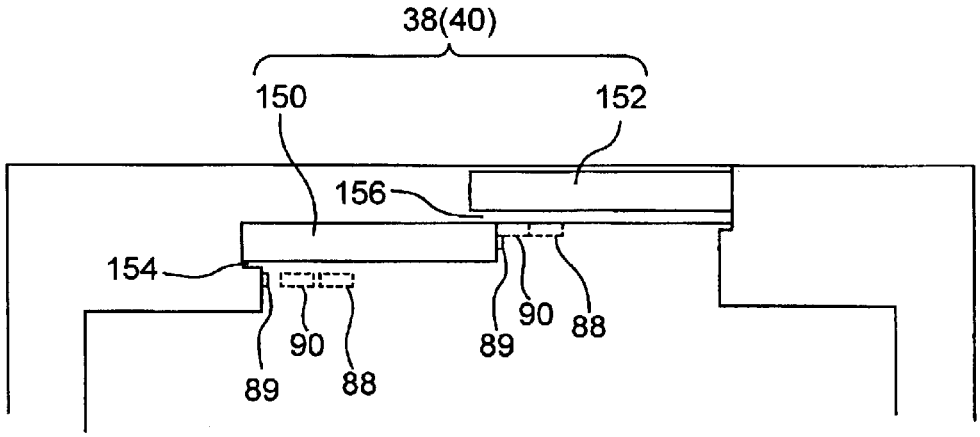
FIG. 17 is a schematic horizontal cross sectional view of a single-leaf door of an elevator system of Embodiment 5, in which the doors are closed.
Figure 18:
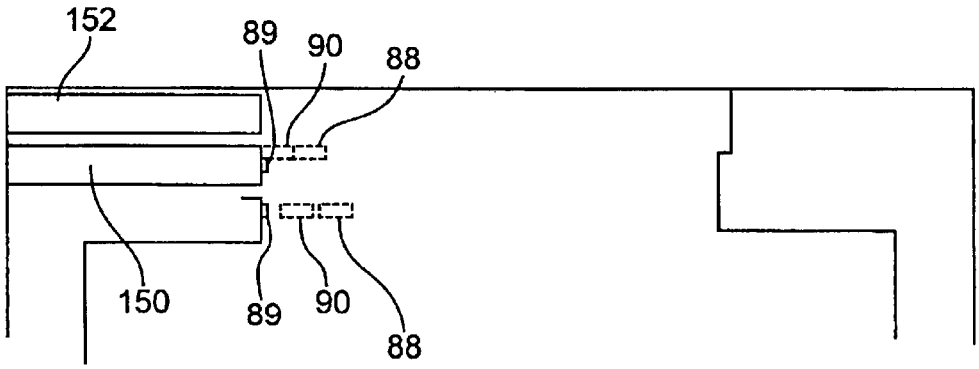
FIG. 18 is a schematic horizontal cross sectional view of the single-leaf door of the elevator system of Embodiment 5, in which the doors are closed.

In the above description, the safety installation of the present invention that is adapted for the double-leaf door is illustrated, it may also be adapted for the elevator system having a single-leaf door as shown in FIGS. 17 and 18. The single-leaf door includes a first door leaf (a lower-rate door) 150 and a second door leaf (a fast-rate door) 152 moving together with the first door leaf 150 in the same moving direction thereof.

In order to prevent any members or passenger's hands from being drawn in the gap 154 defined between the first leaf door 150 and the vertical frame portion 42, 92, the light emitter 88 and the light receiver 90 are provided in and flush with the upper horizontal surface 84, 124, and the light reflector 89 is provided in and flush with the vertical frame surface 82, 122. Also, in order to prevent any members or passenger's hands from being drawn in the gap 156 defined between the first and second leaf doors 150, 152, the light reflector 89 is provided adjacent to a bottom portion of one vertical end surface 158 of the first leaf door 150 that is closer to the doorway, and the light emitter 88 and the light receiver 90 are provided adjacent to a top portion of the vertical end surface 158, protruding towards the moving direction from the vertical end surface 158. Although the light receiver 90 is illustrated closer to the leading vertical end surface of the door leaf than the light emitter 88 the above-mentioned embodiment, the light emitter 88 may be closer to the leading vertical end surface of the door leaf than the light receiver 90. Thus, according to the elevator system of Embodiment 5 has the advantages similar to those of the aforementioned embodiments.

Embodiment 6.

Figure 19:
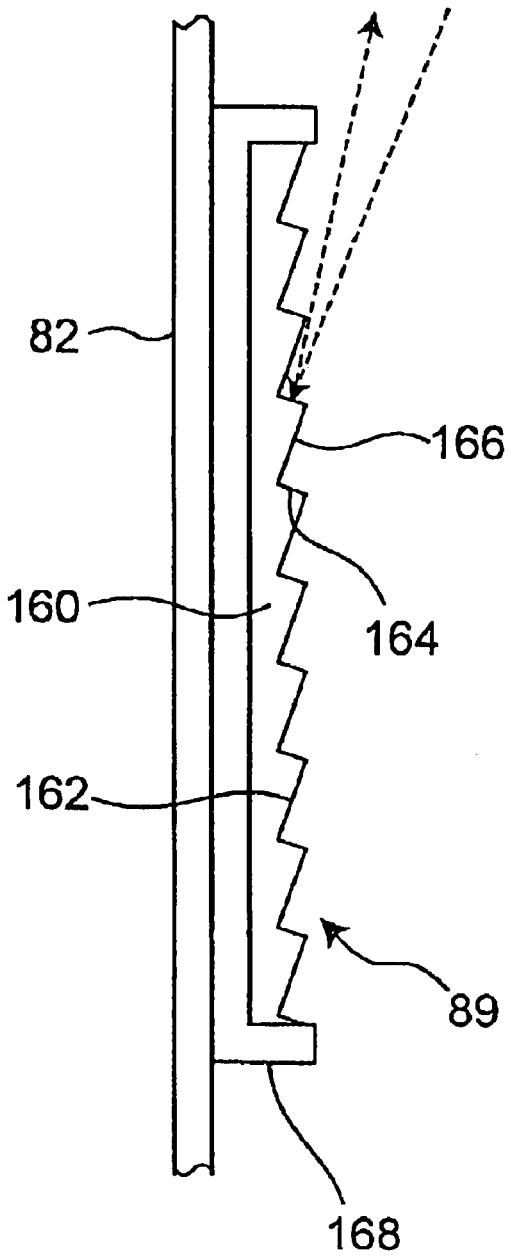
FIG. 19 is an enlarged cross sectional view of a reflector.

Referring to FIG. 19, a particular structure of the light reflector 89 provided on the leading vertical end surfaces 82, 122, 140, 142, 150, and 156 will be described herein. The light reflector 89 includes a mirror 160 having a reflecting surface 162 formed in a stepped configuration and a protection frame 168 for protecting the mirror 160. The protection frame is made of material such as metal and plastic resin. The reflecting surface 162 has a plurality of first and second sub-surfaces 164, 166 formed alternately and perpendicularly to each other so that the light emitted from the light emitter 88 is reflected off at the first sub-surface 164 to the light receiver 90.

According to the light reflector 89 so constructed, it can be designed so as to have a reduced thickness without protruding from the leading vertical end surface 82 and also have an improved reflecting feature, in which the light from the light emitter 88 can be reflected to the light receiver 90 in an efficient manner.

Embodiment 7.

Figure 20:
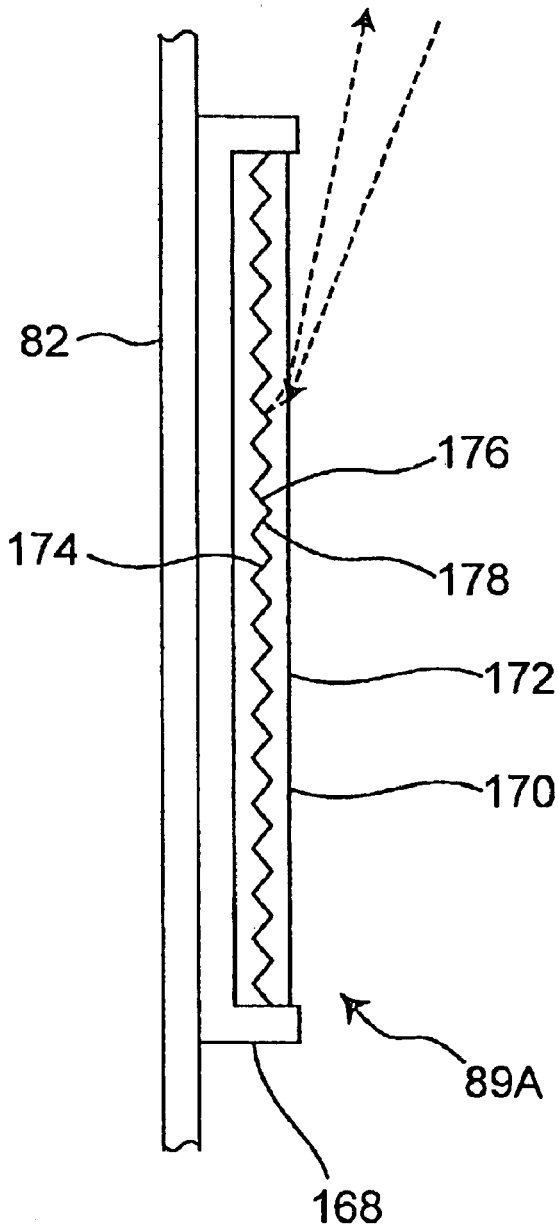
FIG. 20 is an enlarged cross sectional view of another reflector.

FIG. 20 illustrates an another embodiment of the light reflector. The light reflector 89A includes a transparent plate 170 having a plane surface 172 facing to the doorways 34, 35 and a stepped reflecting surface opposing to the plane surface 172, and a protection frame 168 for protecting the transparent plate 170. The reflecting surface 174 has a plurality of first and second sub-surfaces 176, 178 formed alternately and perpendicularly to each other so that the light emitted from the light emitter 88 is refracted at the plane surface 172, reflected off at the first sub-surfaces 176, again refracted at the plane surface 172 to the light receiver 90.

According to the light reflector 89A so constructed, it can be designed so as to have a reduced thickness without protruding from the leading vertical end surface 82 and also have an improved reflecting feature, in which the light from the light emitter 88 can be reflected to the light receiver 90 in an efficient manner. In addition, the plane surface 172 facing to the doorways 34, 35 is plane and vertical so that no dust is retained on the plane surface 172.

Embodiment 8.

Among others, a recursive reflector may be used where the incoming optical path and reflecting optical path are substantially parallel to each other, or a reflecting type diffraction grating may be used.

Embodiment 9.

In the above-mentioned embodiments, although the safety installations 74, 114 are operated before or while the door is driven to open, they may also be operated before or while the door is driven to close, in order to halt or prohibit the opening operation of the door if the existence of any members is determined and to activate the warning device 58, 102, thereby preventing any members and passenger's hands from being hit and pinched by the door leaves.

As described above, according to the elevator system of the present invention, nothing will be drawn into gaps between the door and the neighboring vertical frame or another door, which is so safe to the passengers.

What is claimed is:

1. A sliding door system having a pair of horizontally opposed vertical surfaces defining therebetween an opening, an upper horizontal surface connecting uppermost end of the vertical surfaces, a lower horizontal surface connecting lowermost ends of the vertical surfaces, and a door moving horizontally to open and close the opening, comprising:

a first optical device having a light emitter for emitting light, a second optical device having a light detector for detecting the light, and a light reflector for reflecting the light emitted from the light emitter to the light detector, wherein the light reflector is positioned in at least one of the horizontally opposed vertical surfaces; and the first and second optical devices are positioned in the upper horizontal surface.

2. A sliding door system having a pair of horizontally opposed vertical surfaces defining therebetween an opening, an upper horizontal surface connecting uppermost ends of the vertical surfaces, a lower horizontal surface connecting lowermost ends of the vertical surfaces, and a door moving horizontally to open and close the opening, comprising:

a first optical device having a light emitter for emitting light, a second optical device having a light detector for detecting the light, and a light reflector for reflecting the light emitted from the light emitter to the light detector, wherein the light reflector is positioned in at one of the horizontally opposed vertical surfaces;

one of the first and second optical devices is positioned in the upper horizontal surface; and the other of the first and second optical devices is positioned in the other of the horizontally opposed vertical surfaces, opposing the light reflector.

3. The sliding door system in accordance with claim 1, wherein the light reflector positioned in the vertical surface has a portion facing the opening that is substantially flush with the vertical surface and does not substantially protrude from the vertical surface towards the opening.

4. The sliding door system in accordance with claim 2, wherein the light reflector positioned in the vertical surface has a portion facing the opening that is substantially flush with the vertical surface and does not substantially protrude from the vertical surface towards the opening.

5. The sliding door system in accordance with claim 2, wherein the other of the first and second optical devices positioned in the other of the vertical surfaces has a portion facing the opening that is substantially flush with the vertical surface and does not substantially protrude from the vertical surface towards the opening.

6. The sliding door system in accordance with claim 1, further comprising:

a door driver for driving the door between a closed position where the door completely closes the opening and an opening position where the door completely opens the opening; and a controller for halting the driving of the door driver if the light detected by the light detector is less than a predetermined reference amount of the light before or while the door moves from the closed position and the open position.

7. The sliding door system in accordance with claim 2, further comprising:

a door driver for driving the door between a closed position where the door completely closes the opening and an opening position where the door completely opens the opening; and a controller for halting the driving of the door driver if the light detected by the light detector is less than a predetermined reference amount of the light before or while the door moves from the closed position and the open position.

8. The sliding door system in accordance with claim 1, further comprising:

a warning device;

a door driver for driving the door between a closed position where the door completely closes the opening and an open position where the door completely opens the opening; and a controller for energizing the warning device to alert passengers if the light detected by the light detector is less than a predetermined reference amount of the light before or while the door moves from the closed position and the open position.

9. The sliding door system in accordance with claim 2, further comprising:

a warning device;

a door driver for driving the door between a closed position where the door completely closes the opening and an open position where the door completely opens the opening; and a controller for energizing the warning device to alert passengers if the light detected by the light detector is less than a predetermined reference amount of the light before or while the door moves from the closed position and the open position.

10. The sliding door system in accordance with claim 1, further comprising:

a door driver for driving the door between a closed position where the door completely closes the opening and an open position where the door completely opens the opening; and a controller for halting the driving of the door driver if the light detected by the light detector is outside a predetermined reference range of light before or while the door moves from the closed position and the open position.

11. The sliding door system in accordance with claim 2, further comprising:

a door driver for driving the door between a closed position where the door completely closes the opening and an open position where the door completely opens the opening; and a controller for halting the driving of the door driver if the light detected by the light detector is outside a predetermined reference range of light before or while the door moves from the closed position and the open position.

12. The sliding door system in accordance with claim 1, further comprising:

a warning device;

a door driver for driving the door between a closed position where the door completely closes the opening and an open position where the door completely opens the opening; and a controller for energizing the warning device to alert passengers if the light detected by the light detector is outside a predetermined reference range of light before or while the door moves from the closed position and the open position.

13. The sliding door system in accordance with claim 2, further comprising:

a warning device;

a door driver for driving the door between a closed position where the door completely closes the opening and an open position where the door completely opens the opening; and a controller for energizing the warning device to alert passengers if the light detected by the light detector is outside a predetermined reference range of light before or while the door moves from the closed position and the open position.

14. The sliding door system in accordance with claim 1, wherein the pair of the horizontally opposed vertical surfaces are defined by a pair of fixed vertical frame portions adjacent to the door.

15. The sliding door system in accordance with claim 2, wherein the pair of the horizontally opposed vertical surfaces are defined by a pair of fixed vertical frame portions adjacent to the door.

16. The sliding door system in accordance with claim 1, wherein one of the horizontally opposed vertical surfaces is a leading vertical end surface of the door.

17. The sliding door system in accordance with claim 2, wherein one of the horizontally opposed vertical surfaces is a leading vertical end surface of the door.

* * * * *